United States Patent [19]

Wagonseller

[11] Patent Number: 4,730,732

[45] Date of Patent: Mar. 15, 1988

[54] PALLET AND TOP FRAME FOR SCROLLED DRUM PALLETIZED PACKAGE

[75] Inventor: Walter R. Wagonseller, Naperville, Ill.

[73] Assignee: Continental Fibre Drum, Inc., Stamford, Conn.

[21] Appl. No.: 432,038

[22] Filed: Sep. 30, 1982

[51] Int. Cl.[4] ..... B65D 19/24

[52] U.S. Cl. ..... 206/597; 108/51.1; 108/55.1; 206/446; 206/386; 410/36; 410/42; 414/63

[58] Field of Search ..... 206/597, 386, 446, 595, 206/596, 598, 599, 600; 217/43 A; 108/51.1, 52.1, 53.1, 53.3, 53.5, 54.1, 55.1, 56.1, 55.3; D34/39; 410/42, 36, 31; 414/63, 59

[56] References Cited

U.S. PATENT DOCUMENTS

| | | | |
|---|---|---|---|
| 2,377,911 | 6/1945 | Warren | 108/54.1 |
| 2,444,326 | 6/1948 | Baker et al. | 108/55.3 |
| 2,658,614 | 11/1953 | Van Patten | 206/595 |
| 2,700,521 | 1/1955 | Lapham | 108/52.1 |
| 2,904,297 | 9/1959 | Hamilton | 108/51.3 |
| 3,563,184 | 2/1971 | Angelbeck, Jr. | 108/53.1 |
| 3,638,790 | 2/1972 | Schmid | 206/446 |
| 3,710,732 | 1/1973 | Phelps | 108/51.1 |
| 3,834,323 | 9/1974 | Wernmann | 108/51.1 |
| 4,004,552 | 1/1974 | Levin | 217/26.5 |
| 4,061,391 | 12/1977 | Violette | 206/597 |
| 4,145,974 | 3/1979 | Fleming et al. | 108/51.1 |
| 4,184,435 | 1/1980 | Shevchenko | 108/51.1 |
| 4,324,190 | 4/1982 | Hewitt | 108/51.1 |
| 4,361,232 | 11/1982 | Olmsted | 206/386 |

*Primary Examiner*—Stephen Marcus
*Assistant Examiner*—Bryon Gehman
*Attorney, Agent, or Firm*—Charles E. Brown

[57] ABSTRACT

This relates to a package of cylindrical containers such as drums which have scrolled edges so that the drums or containers may be assembled in nested relation on the pallet and drums of adjacent pallets may internest. Accordingly, there is provided a pallet and a cooperating hold-down which include supports extending longitudinally of each row of containers in a manner wherein a strap or band may engage around each row of containers and lock the same in assembled relation with respect to the support members or pallet and hold-down. The thus banded-together pallet, containers and hold-down form a rigid package having a scrolled edge wherein adjacent packages will internest to provide for a maximum loading of drums or other cylindrical containers in a transporting vehicle.

5 Claims, 5 Drawing Figures

PALLET AND TOP FRAME FOR SCROLLED DRUM PALLETIZED PACKAGE

This invention relates in general to new and useful improvements in pallets and packages formed therefrom, and more particularly to a pallet assembly for packaging drums and like cylindrical containers in a manner wherein the containers in adjacent rows are offset or internested so that the side edges of the assembled package have a scroll-like arrangement with the pallet being particularly adapted to internest with the next adjacent pallet.

In accordance with this invention, it is proposed to provide a pallet which is of a width substantially equal to that of a truck or trailer body wherein, once the pallet has been loaded into the vehicle, a next adjacent pallet will interlock therewith so that drums or other cylindrical containers packaged thereon may be in internested relation and thus a larger number of containers such as drums may be loaded into a selected size of vehicle.

In accordance with this invention, the pallet is formed of a plurality of stringers which extend the length of the pallet and which would extend transversely of the vehicle when the pallet is loaded thereinto. The stringers are arranged in spaced parallel relation and are joined together by support members which overlie the stringers and wherein each support member extends beyond one side of the stringers with adjacent support members extending alternatingly to opposite sides of the stringers to provide for a scroll effect.

The pallet assembly also includes a top hold-down member which preferably is in the form of a plurality of boards having their ends staggered in the same manner as the support members and joined together by a single stringer.

The containers to be packaged will be loaded onto the pallet in nested relation and then the hold-down will be positioned on top of such stacked containers and all of the containers in each row, as determined by a support member, will be fixedly secured relative to the package by suitable banding.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
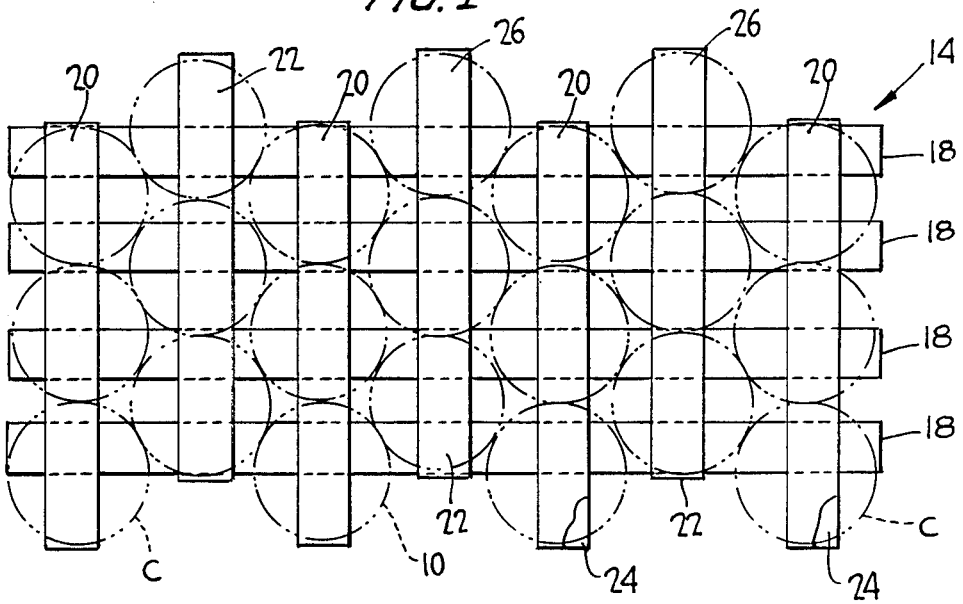
FIG. 1 is a plan view of a pallet formed in accordance with this invention with portions broken away and the position of the drums or like containers to be supported thereby being shown in phantom lines.

Referring now to the drawings in detail, as is clearly illustrated in FIG. 1, it is desired to package cylindrical containers, such as fibredrums C, arranged in nested relation. Thus, when a truck is loaded with a package of such containers C, the containers may all internest and a much larger number of such containers may be packed in a like size vehicle than is possible if the containers are arranged in rows and columns on a conventional pallet or pallets.

Figure 5:
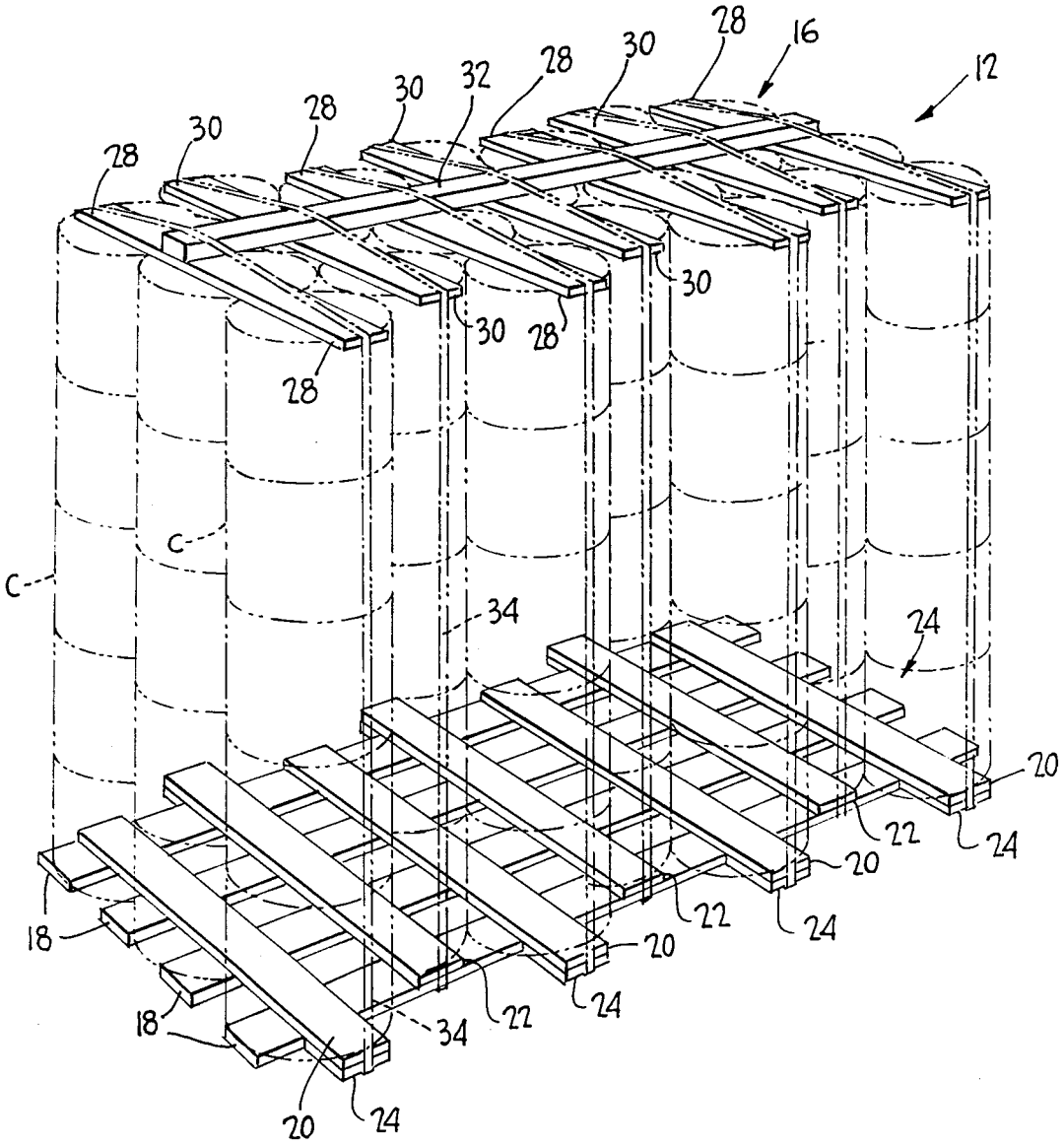
FIG. 5 is a perspective view of a package incorporating the pallet and the hold-down with the containers to be packaged and the banding straps being shown in phantom lines.

In accordance with this invention, there is provided a package construction, generally identified by the numeral 12 and best shown in FIG. 5. The package 12 includes as a base a pallet 14, and also includes an uppermost hold-down 16.

Referring now to FIG. 1, it will be seen that the pallet 14 includes a plurality of stringers 18 which may be said to be arranged longitudinally of the pallet 14, but which stringers would extend transversely of a vehicle in which packages 12 are loaded. These stringers 18 may be in the form of conventional 1"×6" boards, and will be spaced apart in parallel relation. The stringers 18 are joined by a plurality of support members 20 and 22 which extend transversely of the stringers 18 and will be secured thereto by way of conventional fastening methods including nailing or stapling. It will be seen that the support members 20, 22 are also formed of 1"×6" boards which are arranged in spaced parallel relation. It will also be seen that each support member 20 terminates along the side edge of one exterior stringer 18 while projecting beyond the side edge of the other and remote outermost stringer. In a like manner, each support member 22 has one end terminating at the side edge of the other stringer 18 while projecting beyond the side edge of the one stringer.

Figure 2:
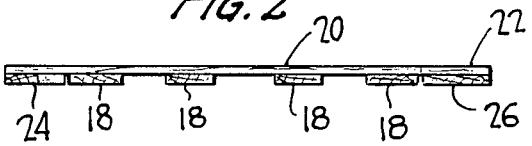
FIG. 2 is an end elevational view of the pallet of FIG. 1.
Figure 3:
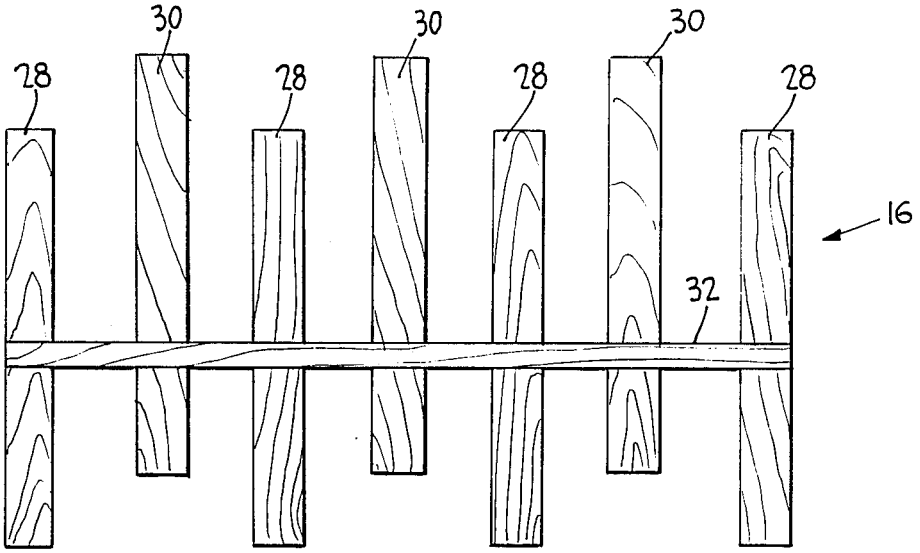
FIG. 3 is a top plan view of a hold-down for use in cooperation with the pallet of FIG. 1.
Figure 4:
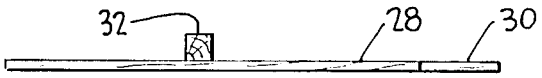
FIG. 4 is an end elevational view of the hold-down.

It will also be seen that that portion of each support member 20 which projects beyond the associated outermost stringer has secured to the underside thereof a support member or spacer 24. A similar support member or spacer 26 is secured to the underside of the projecting portion of each of the support members 22. Thus, as is clearly shown in FIG. 2, the projecting portions of the support members 20, 22 are provided with suitable supports 24 and 26 which lie flush with the stringers 18.

Referring once again to FIG. 1, it will be seen that when containers C, such as drums, are positioned on the pallet 14, each row of containers C will be centered on a respective support 20, 22 with the containers of adjacent rows being in nested relation. As a result, the longitudinal or side edge of the pallet 14, with the containers C stacked thereon, will have a scroll-cut effect.

In order to hold the containers C in place on the pallet 14, there is provided a hold-down 16. The hold-down 16 includes a plurality of support members 28 and 30, the ends of which are staggered in the same manner as are the ends of the support members 20, 22. The spacing of the support members 28, 30 is the same as that of the support members 20, 22, and the support members 28, 30 are joined together by a single longitudinal stringer 32 which overlies the support members 28, 30 and is secured thereto by suitable fastening means including nailing.

After the containers C have been positioned on the pallet 14 in the nested relation shown in FIG. 1 and have been stacked to the desired height, the hold-down 16 is applied and then each row of stacked containers C is tightly clamped by means of straps or bands 34, as is best shown in FIG. 5, to form the package 12. It will be seen from FIG. 5 that each support member 28 overlies a support member 20 while each support member 30 overlies a support member 22. Each strap or band 34 is centered relative to the pairs of support members and tightly engages the same so as to clamp the containers stacked in between so as to prevent relative slipping of such containers.

After a package 12 has been formed, it is loaded widthwise, i.e. the length of the stringers 18, into the transporting vehicle, with care being exercised that the scrolled edges of the adjacent pallets will internest so that each projecting end of a support member will be in end-to-end relation with respect to a like support member and therefore the nested continuity of the containers is maintained.

Although only a preferred embodiment of the package and the pallet and hold-down which form major components of the package have been specifically illustrated and described herein, it is to be understood that minor variations may be made in the pallet hold-down and package without departing from the spirit and scope of the invention as defined in the appended claims.

I claim:

1. A pallet for forming a package of plural cylindrical members, said pallet comprising a plurality of generally like length and parallel flat supporting surface engaging stringers, and a plurality of flat article receiving like center-to-center spaced support members secured to and extending transversely of said stringers, said stringers including first and second outer stringers, at least one end portion of each of said support members extending transversely of an adjacent one of said outer stringers, said end portions of said support members projecting alternatingly from said first outer stringer and said second outer stringer, said members overlying said stringers, and that part of each support member end portion extending beyond a respective one of said outer stringers having a spacer underlying the same, said spacer being of a thickness according to the thickness of said stringers.

2. A pallet according to claim 1 wherein said stringers and said support members are in the form of flat boards.

3. A pallet for forming a package of plural cylindrical members, said pallet comprising a plurality of generally like length and parallel flat supporting surface engaging stringers, and a plurality of flat article receiving like center-to-center spaced support members secured to and extending transversely of said stringers, said stringers including first and second outer stringers, at least one end portion of each of said support members extending transversely of an adjacent one of said outer stringers, said end portions of said support members projecting alternatingly from said first outer stringer and said second outer stringer, and a hold-down, said hold-down overlying said pallet and having support members corresponding to said pallet support members and of a like alternating projection.

4. A pallet according to claim 3 wherein there are stacks of cylindrical members between said pallet and said hold-down, said stacks being arranged in rows on said pallet support members, and bands generally centered on and surrounding each row of stacks and corresponding ones of said support members.

5. A pallet according to claim 4 wherein said cylindrical members of adjacent rows are internested.

* * * * *